United States Patent [19]

Brown et al.

[11] Patent Number: 4,757,829

[45] Date of Patent: Jul. 19, 1988

[54] EXPANSION OF VEGETABLE MATERIAL

[75] Inventors: Ian C. Brown, Winchester; David J. Molyneux, Southampton, both of England

[73] Assignee: British-American Tobacco Co., Ltd., London, England

[21] Appl. No.: 920,089

[22] Filed: Oct. 17, 1986

[30] Foreign Application Priority Data

Dec. 5, 1985 [GB] United Kingdom ..... 8530019

[51] Int. Cl.[4] ..... A24B 3/18

[52] U.S. Cl. ..... 131/296

[58] Field of Search ..... 131/296; 99/323.4–323.11

[56] References Cited

U.S. PATENT DOCUMENTS 4,523,598 6/1985 Weiss ..... 131/296

4,561,453 12/1985 Rothchild ..... 131/296

*Primary Examiner*—V. Millin

*Attorney, Agent, or Firm*—Charles G. Lamb

[57] ABSTRACT

In a method of expanding tobacco the tobacco is contacted in a first vessel with an expansion agent and, with the vessel being closed and liquid phase expansion agent in the tobacco being at a temperature above the boiling point at a lower, release pressure, the first vessel is connected to a closed second vessel the interior of which is at the release pressure. When the tobacco is contacted in the first vessel with the expansion agent, the tobacco is maintained in a mobilized, particle separated condition by supplying gaseous mobilizing medium to a mobilizing zone of the first vessel via nozzles located at upwardly diverging walls bounding the zone and preferably supplying in addition gaseous accelerating medium to the zone in an upward direction from a lower region of the zone.

11 Claims, 2 Drawing Sheets

EXPANSION OF VEGETABLE MATERIAL

This invention relates to the expansion of tobacco and other vegetable materials.

In Specification No. 2 141 015 A of our United Kingdom Patent Application No. 8413718 there is disclosed a method of expanding tobacco lamina, the method comprising contacting tobacco lamina with an organic expansion agent having a boiling point temperature at a pressure of one atmosphere of at least about 10° C., heating within the interior of a closed first vessel tobacco lamina thus contacted so that the temperature of the agent in the liquid phase in the tobacco lamina attains a temperature value above the boiling point of the agent corresponding to a release pressure lower than the pressure in the first vessel at the temperature value, and subsequently bringing the interior of the vessel suddenly into gas flow communication with the interior of a closed second vessel in which the pressure immediately before the establishment of said communication is the release pressure, whereby the filling value of the tobacco lamina is increased by at least 50%. This expansion method can be readily carried out with small charges of tobacco. However, with larger charges difficulty has been experienced in obtaining a uniform heating of the tobacco and a uniform impregnation of the tobacco with the expansion agent. These problems may be especially pronounced in the case in which the agent, when applied to the tobacco, is in the vapour phase, the intention being that the agent should condense on the tobacco.

The present invention is based on the recognition that the heating and impregnation steps of the expansion method of Specification No. 2 141 015 A, and of similar expansion methods, may be carried out more effectively if, when the agent is brought into contact with the material to be expanded, the material is in a mobilised state, as that term is used herein.

When a body of particulate material is in a mobilised state, as that term is used herein, the individual particles are maintained in a separated condition so that the particles are free to move relatively to each other. With reference to cut lamina tobacco, or other material which comprises fibrous particles, the term mobilisation further means that the material is wholly or substantially disentangled and maintained in a disentangled, particle separated condition.

We have devised a mobilisation method, effective for the mobilisation of particulate material, wherein particulate material is maintained in a mobilised state in a mobilisation zone bounded by wall means upwardly divergent from the vertical, whereby the horizontal cross-sectional area of the mobilisation zone increases in an upward direction thereof, gaseous mobilising medium being supplied at a multiplicity of sites of the wall means to the mobilisation zone whereby there obtains in the zone a circulating pattern comprising downward flow at the wall means and upward flow from a lower region of the zone. This mobilisation method is referred to hereinbelow as "the mobilisation method as defined". For further information concerning the mobilisation method as defined reference may be had to United Kingdom Patent Specification No. 2 170 305 A.

The present invention provides a method of expanding particulate vegetable material, wherein a charge of the material is mobilised in a first vessel in accordance with the mobilisation method as defined, in United Kingdom Patent Specification No. 2 170 305 A. The term mobilization means a controlled process in which a body of particulate material individual particles are maintained in a substantially separated condition so that the particles are free to move relatively to each other. With reference to fibrous particulate material, mobilization further means that the material is wholly or substantially disentangled and maintained in a disentangled, particle separated condition. The thus mobilised material is contacted with an expansion agent to uniformly impregnate the material with said agent in the liquid phase thereof, and, with said first vessel being closed and with the temperature of the liquid phase agent in the material being at a temperature value above the boiling point of the agent corresponding to a release pressure lower than the pressure in the first vessel at said temperature value, the interior of said first vessel is brought suddenly into gas flow communication with the interior of a closed second vessel in which the pressure immediately before the establishment of said communication is said release pressure.

Advantageously, in carrying out the inventive method, the mobilisation method as defined further comprises the supply of gaseous accelerating medium to the mobilisation zone in an upward direction from a location at a lower region of the zone. The accelerating flow serves to enhance the circulation of the mobilised body of particles of vegetable material.

Tobacco subjected to the inventive expansion method may be cut lamina tobacco or a blend of cut lamina tobacco and a cut stem tobacco.

When the expansion agent is applied to the tobacco or other vegetable material particles, the expansion agent may be in the vapour phase thereof. If, as is convenient, the material to be expanded when placed in the first vessel is at or near room temperature, the vapour phase expansion agent will condense on and impregnate the particles of the material. In condensing on the particles, the expansion agent will give up heat to the particles.

When the expansion agent is applied to the material to be expanded in the vapour phase of the expansion agent, the expansion agent may be used as the mobilising medium or may constitute a proportion of the mobilising medium. Alternatively, or in addition, when a flow of accelerating medium is utilised, the vapour phase expansion agent may be used as the accelerating medium or may constitute a proportion of the accelerating medium. After an initial phase or mobilisation, in which phase a gas, or gases, other than vapour phase expansion agent is/are utilised as mobilising and accelerating media, one or both media flows, or a proportion of one or both, is/are replaced by a flow of vapour phase expansion agent. Alternatively, the mobilising and accelerating media are constituted by a gas or gases other than vapour phase expansion agent and, instead of vapour phase expansion agent subsequently being supplied as or with one or both of the media flows, the mobilised charge is contacted with expansion agent in the liquid phase of the expansion agent. The liquid phase expansion agent may in this case be sprayed onto the mobilised particulate material charge from spray means located above the mobilisation zone, or agent may be introduced into the mobilised charge from probe means projecting into the mobilisation zone.

Advantageously, the expansion agent is a single or multi component organic expansion agent. Suitably, the expansion agent has an atmospheric boiling point of at least 10° C. More suitably, the atmospheric boiling point should be in excess of 20° C. The expansion agent may be in accordance with the teaching of United Kingdom Patent Specification No. 2 160 408 A.

In carrying out the expansion method of the present invention, during the mobilisation in the first vessel of the material to be expanded the first vessel may be heated.

The release pressure may be atmospheric pressure, but is suitably sub-atmospheric, preferably of the order of 15 kPa or less.

The time over which the pressure release takes place should be as short as possible and preferably not more than five seconds.

The present invention also provides expansion apparatus comprising a first closable vessel, a mobilisation zone in said first vessel, said zone being bounded by wall means, the wall means being upwardly divergent from the vertical, whereby the horizontal cross-sectional area of said zone increases in an upward direction thereof, mobilisation nozzle means operable to supply gaseous mobilising medium at a multiplicity of sites of said wall means, a second closable vessel, and valve means operable to bring the interior of said first vessel suddenly into gas-flow communication with the interior of said second vessel.

Advantageously, the apparatus comprises acceleration nozzle means operable to supply gaseous accelerating medium to the mobilisation zone of the first vessel in an upward direction from a location at a lower region of the zone.

Advantageously, there is provided containment means, insertable into and removable from the interior of the first vessel through sealingly closable access means, base walls of which containment means, or portions of the base walls, providing, when the containment means is fully inserted into the first vessel, the wall means, or a major proportion thereof, bounding the mobilisation zone.

Expansion apparatus according to the present invention may also comprise gas circulation means operable to circulate gas and/or vapour from the interior of the first vessel above the mobilization zone to the mobilisation zone via the mobilisation nozzle means.

Expansion apparatus according to the present invention may advantageously further comprise vacuum means operable to draw a partial vacuum in the second vessel.

If it is intended that expansion agent should be introduced to the mobilisation zone in the liquid phase of the agent, the apparatus may also comprise spray means located above the mobilisation zone or probe means projecting into the mobilisation zone.

The apparatus can with advantage comprise heating means operable to maintain the walls of the first vessel, and components of the containment means, if containment means is provided, at a temperature above the boiling point temperature of the expansion agent at the maximum operating pressure attained in the first vessel. If cold liquid phase expansion agent is introduced to the mobilisation zone, the heating means is advantageously operable to supply heat to the mobilised material.

In order that the present invention may be clearly understood and readily carried into effect, reference will now be made, by way of example, to the diagrammatic drawings hereof, in which.

Figure 1:
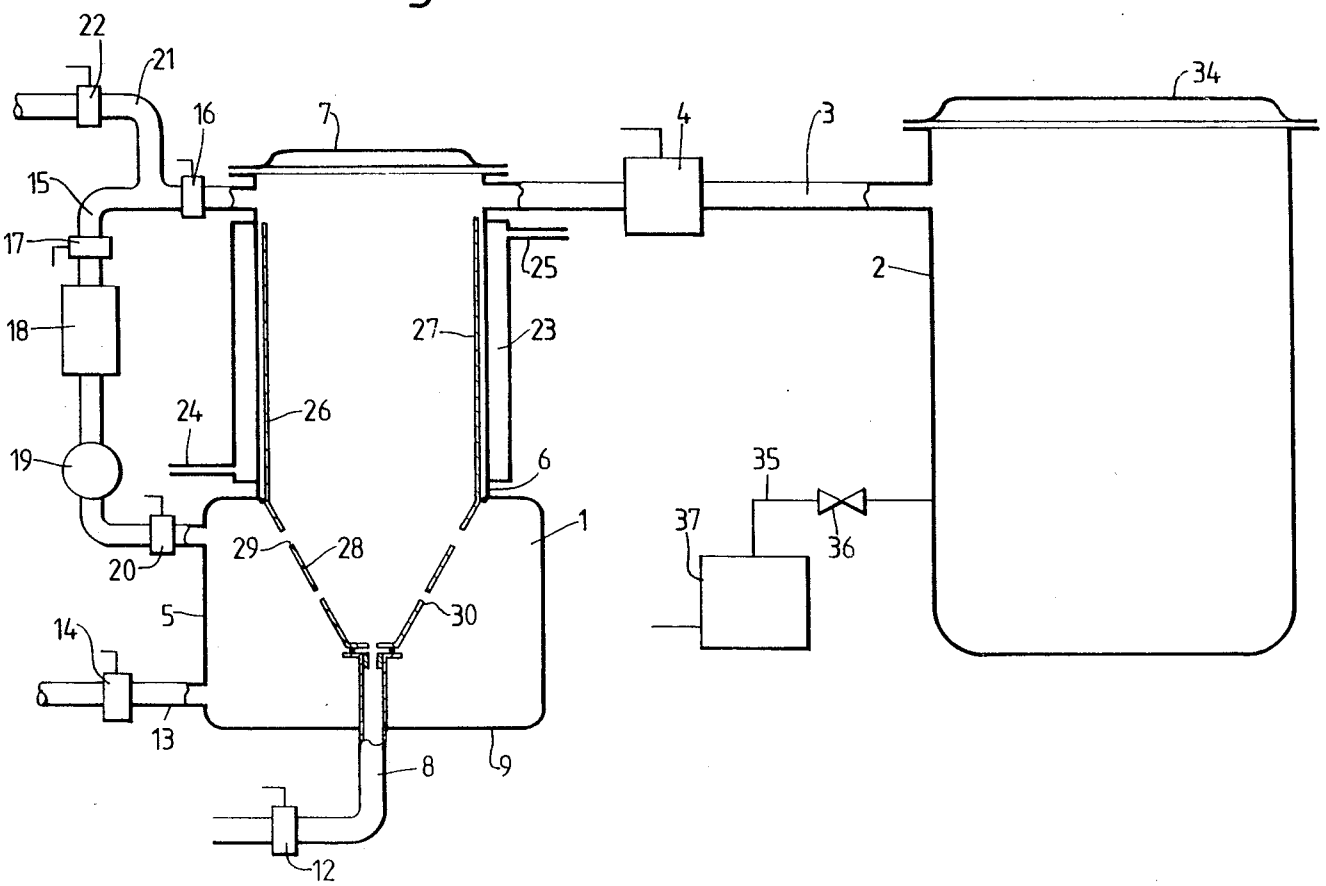
FIG. 1 shows an expansion apparatus.

The expansion apparatus shown in FIG. 1 comprises a first pressure vessel 1, a second pressure vessel 2 and a pipe 3, by which pipe the interiors of the vessels 1 and 2 can be intercommunicated when a ball valve 4 fitted in the pipe 3 is set to the open condition thereof.

The pressure vessel 1 comprises a lower, cylindrical portion 5 from which there upwardly extends a lesser diameter upper, cylindrical portion 6. At the upper end of the portion 6, the vessel 1 is fitted with a removable lid 7.

Figure 2:
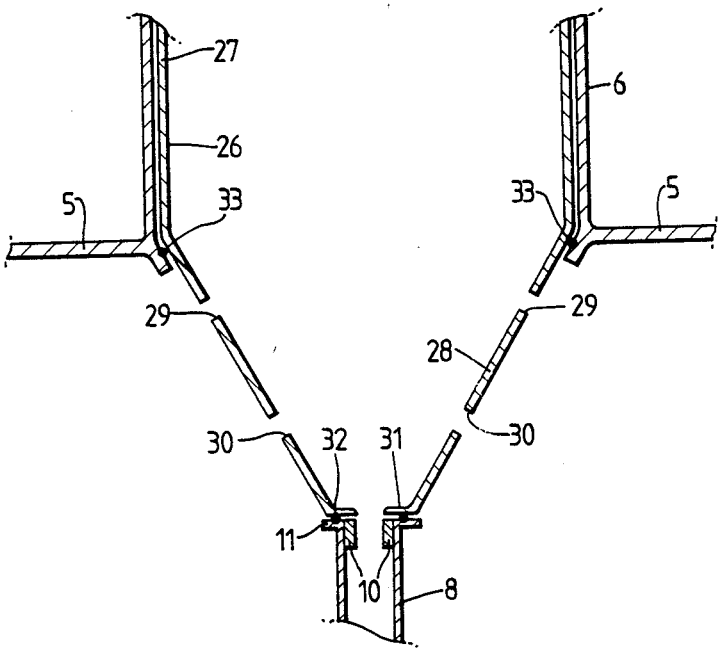
FIG. 2 shows, to a somewhat larger scale, a detail of the apparatus of FIG. 1.

A first gas-supply pipe 8 extends through a base wall 9 of the portion 5 of the vessel 1 and vertically upwardly within the portion 5. At its upper end, disposed within the portion 5, the pipe 8 is fitted interiorly with an orifice plate 10 (see FIG. 2) providing acceleration nozzle means. A bearing flange 11 extends outwardly at the upper end of the pipe 8. Exteriorly of the vessel 1, the pipe 8 is fitted with a valve 12.

A second gas-supply pipe 13, fitted with a valve 14, opens at the interior of the portion 5 of the vessel 1.

A gas-circulation pipe 15 extends from an upper location of the portion 6 to the portion 5 of the vessel 1. In the pipe 15 are fitted valves 16 and 17, a gas scrubber 18, a gas pump 19 and a valve 20. A purge pipe 21, in which is fitted a valve 22, branches from the pipe 15 intermediate the valves 16 and 17.

A steam jacket 23 extends about the portion 6 of the vessel 1. Steam inlet and outlet lines 24 and 25 extend to and from the jacket 23.

An open top container 26, providing containment means, is received in the vessel 1 and may be removed therefrom upon removal of the lid 7. The container 26, which may, for example, be made of aluminium, comprises and upper, cylindrical portion 27 and a lower portion 28 of inverted conical form. The portion 28, which provides wall means bounding a mobilisation zone, is provided with upper and lower encircling rows of perforations 29 and 30 intercommunicating the interiors of portion 5 of vessel 1 and the container 26 and providing mobilisation nozzle means.

At the lower end thereof the portion 28 of the container 26 is provided with an inwardly extending flange 31 which, when the container 26 is in its lowermost position within the vessel 1, is supported on the bearing flange 11 of the pipe 8. The flange 31 defines an opening of a diameter somewhat in excess of the upper, exit diameter of the orifice plate 10. 'O'-ring 32 provides a gas-tight seal between the flanges 11 and 31. A further 'O' ring 33 provides a gas-tight seal between the portion 28 of the container 26, at the upper end of the portion 28, and the vessel 1 in the vicinity of the juncture of the portions 5 and 6 of the vessel 1.

In order to facilitate ready insertion and removal of the container 26 into and from the vessel 1, guide means (not shown) may be provided on the exterior of the portion 27 of the container 26 and/or the interior of the portion 6 of the vessel 1. Such guide means also serves to enhance heat transfer from the steam jacket 23 to the walls of the portion 27 of the container 26.

The vessel 2 is fitted with a removable lid 34. Connected to the vessel 2, via a line 35 fitted with a valve 36, is a vacuum pump 37.

When the expansion apparatus is to be used to expand cut lamina tobacco, a charge of the tobacco is placed in the portion 28 of the container 26. With the container 26 in the lowermost position thereof in the vessel 1, with the lid 7 in the closed position thereof, the valves 14, 16 and 32 in the open conditions thereof and the valves 4, 12, 17 and 20 in the closed conditions thereof, nitrogen gas, from a source (not shown) of pressurised nitrogen is supplied to the portion 5 of the vessel 1 through the pipe 13 for a time sufficient to purge both portions 5 and 6 of vessel 1 of air. At completion of the air purging step the valves 16 and 22 are closed, while valve 14 remains in its open condition for the continued supply of nitrogen to vessel 1. Valve 12 is then opened to admit a flow of vapour phase expansion agent through the pipe 8 from a source (not shown) of pressurised expansion agent.

With gaseous nitrogen flowing through the perforations 29 into the container 26 and with vapour phase expansion agent flowing into the container 26 from the pipe 8, the charge of tobacco in the container 26 is fully mobilised., Thus the expansion agent, which may, for example, be an 80%:20% by weight n-pentane:acetone expansion agent, is brought into uniform contact with the tobacco particles. In that the tobacco when placed in the container 26 is at room temperature, whereas the vapour phase expansion agent is at an elevated temperature, 100° C. for example, expansion agent condenses on the tobacco particles, the latter being impregnated with the condensate and being heated by the latent heat of the expansion agent.

By means of the steam jacket 23 the walls of the portion 6 of the vessel 1 and the walls of the portion 27 of the container 26 are maintained at a temperature in excess, by, for example, 5° C., of the temperature of the vapour phase expansion agent. Thus the expansion agent is prevented from condensing on the aforementioned walls.

When the pressure in the vessel 1 reaches a predetermined value, 100 pounds per square inch (680 kPa) gauge for example, valve 14 is closed and valves 16, 17 and 20 are opened to permit the circulation of nitrogen gas and vapour phase expansion agent under action of the pump 19 from the upper end of the vessel 1, through the pipe 15 to the portion 5 of the vessel 1 exteriorly of the portion 28 of the container 26. The gas/vapour mixture passing through the perforations 29 together with the continuing supply of vapour phase expansion agent from pipe 8 serve to maintain the mobilised state of the tobacco in the container 26.

At the commencement of, or during the circulation via pipe 15, supply of expansion agent from the pipe 8 may be replaced by a supply therefrom of nitrogen gas.

After the elapse of sufficient time for the mobilised tobacco to have become fully impregnated with liquid phase expansion agent, the pump 19 is stopped and the valves 12, 16, 17 and 20 are closed, whereby the charge of tobacco in vessel 1 ceases to be mobilised.

With a partial vacuum of, for example, 15 kPa absolute having been created in vessel 2 by operation of the vacuum pump 37, and with the valve 36 having been put into the closed condition thereof, the valve 4 is opened, whereby the pressure in vessel 1 is suddenly reduced, this resulting in a flashing off of the liquid expansion agent in the tobacco particles, i.e. an instantaneous reversion of the agent to the vapour phase thereof. The flashing off of the expansion agent results in an expansion of the tobacco particles. The tobacco is also cooled by virtue of heat energy taken from the tobacco in the evaporation of the expansion agent.

In order to remove the expanded tobacco from the vessel 1, valve 4 is closed and then valves 16 and 22 are opened to bring the pressure within vessel 1 to atmospheric pressure. The lid 7 may then be removed or swung to its open position and the container 26 removed from vessel 1.

According to a modification of the above described apparatus, instead of use being made of a removable container in vessel 1, perforated walls similar to the walls defining portion 28 of the container 26 are provided as components of the vessel 1. In such case the charge of material to be expanded may, after completion of the expansion process, be removed from the vessel 1 by pneumatic discharge means (not shown). A pneumatic discharge means may take the form of a mask which extends outwardly of a vertically extending discharge duct to the walls of the portion 6 of the vessel 1, the mask and duct being movable to the mobilisation zone.

What is claimed is:

1. A method of expanding particulate vegetable material, comprising the steps of placing a charge of the vegetable material to be expanded in a mobilization zone of a first closed vessel, introducing a flow of mobilizing gas into the closed vessel to mobilize the vegetable material therein, introducing an expansion agent at a higher temperature than the temperature of the mobilized vegetable material to be expanded into the closed vessel and contacting the mobilized vegetable material with the expansion agent in the mobilization zone to uniformly impregnate the vegetable material with said agent in the liquid phase thereof as the expansion agent condenses on the cooler vegetable material, and after a sufficient length of time to provide for impregnation of the vegetable material, suddenly reducing the pressure in the first closed vessel to a pressure below the vapor pressure of the expansion agent causing the liquid phase condensate of the expansion agent impregnating the vegetable material to flash vaporize thereby resulting in an expansion of the vegetable material in the first closed vessel.

2. The method of claim 1, comprising the further step of introducing a flow of gaseous accelerating medium into the mobilization zone contacting the mobilized vegetable material in an upward direction from a location at a lower region of the mobilization zone.

3. A method as claimed in claim 1, wherein the mobilising medium comprises said expansion agent.

4. A method as claimed in claim 2, wherein said accelerating medium comprises said expansion agent.

5. A method as claimed in claim 1, wherein said material is a particulate tobacco material.

6. An apparatus for expanding vegetable material comprising a first closable vessel, a mobilization zone in said first vessel, said zone being bounded by wall means, the wall means being upwardly divergent from the vertical, whereby the horizontal cross-sectional area of said zone increases in an upward direction thereof, mobilization nozzle means operable to supply gaseous mobilizing medium at a multiplicity of sites of said wall means, a second closable vessel, a pipe establishing gas flow communication between the mobilization zone of said first vessel and said second vessel, and value means in said pipe operable to open gas-flow communication through said pipe to bring the interior of the first vessel suddenly into gas-flow communication with the interior of said second vessel.

7. Apparatus as claimed in claim 6 and further comprising acceleration nozzle means operable to supply gaseous accelerating medium to said mobilisation zone in an upward direction from a location at a lower region of said zone.

8. Apparatus as claimed in claim 6 or 7 and further comprising containment means insertable into and removable from said first vessel, base walls of said containment means, or portions of said base walls, providing, when said containment means is fully inserted into said first vessel, said wall means, or a major proportion thereof, bounding said mobilisation zone.

9. Apparatus as claimed in claim 6, and further comprising gas circulation means operable to circulate gas and/or vapour from the interior of said first vessel above said mobilisation zone to said mobilisation zone via said mobilisation nozzle means.

10. Apparatus as claimed in claim 6 and further comprising heating means operable to heat mobilised material in said mobilisation zone.

11. The method of claim 1, wherein the flow of mobilizing gas in the mobilization zone of the first closed vessel circulates in the mobilization zone generally upwardly through the body of the vegetable material to be expanded and downwardly at the boundary of the mobilization zone.

* * * * *